US006278659B1

(12) United States Patent
Yokouchi

(10) Patent No.: US 6,278,659 B1
(45) Date of Patent: Aug. 21, 2001

(54) SENSOR MOUNTING STRUCTURE AND ELECTRONICS AND WATCH HAVING THE STRUCTURE

(75) Inventor: Kiyomitsu Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/485,941

(22) PCT Filed: Jun. 18, 1999

(86) PCT No.: PCT/JP99/08286

§ 371 Date: Apr. 19, 2000

§ 102(e) Date: Apr. 19, 2000

(87) PCT Pub. No.: WO99/67687

PCT Pub. Date: Dec. 29, 1999

(30) Foreign Application Priority Data

Jun. 22, 1998 (JP) ..... 10-175103

(51) Int. Cl.[7] ..... G04B 47/06
(52) U.S. Cl. ..... 368/11
(58) Field of Search ..... 368/10–12, 323, 368/244–246; 73/754, 291, 384, 386, 437, 753

(56) References Cited

U.S. PATENT DOCUMENTS 4,783,772 * 11/1988 Umemoto et al. ..... 368/11
5,357,488 * 10/1994 Udo et al. ..... 368/11
5,592,442 * 1/1997 Nishikawa ..... 368/11

FOREIGN PATENT DOCUMENTS 63-93583 6/1988 (JP) .
2-65188 5/1990 (JP) .
5-75695 10/1993 (JP) .
6-69882 9/1994 (JP) .
7-270551 10/1995 (JP) .
8-179061 7/1996 (JP) .

* cited by examiner

*Primary Examiner*—Bernard Roskoski

(57) ABSTRACT

In order to provide a sensor-mounting structure which is applicable to various apparatuses, such as electronic apparatuses and portable apparatuses, and which reduces the number of components, simplifies assembly operation, prevents tampering from outside, and the reduces the cost of manufacturing, a pressure sensor 23 is inserted into a mounting pipe 22 from the inside and is pressed and supported by a pressing plate from the back. An engaging end 25*b* formed on the upper end of the pressing plate 25 engages with an engaging rib 20*c*, and a fixing plate 25*d* formed on the lower end is fixed to a fixing surface 21*c* by a fixing screw 26.

9 Claims, 5 Drawing Sheets

SENSOR MOUNTING STRUCTURE AND ELECTRONICS AND WATCH HAVING THE STRUCTURE

TECHNICAL FIELD OF THE INVENTION

The present invention relates to a sensor-mounting structure, and an electronic apparatus and a wristwatch including the same. More particularly, the present invention relates to a technique suitable as a structure for mounting a pressure sensor for detecting external pressure to a case partition wall for partitioning the inside and outside of the electronic apparatus and the wristwatch.

DESCRIPTION OF THE RELATED ART

Hitherto, wristwatch-type diver's watches, diver's computers and the like especially designed for divers have been sold commercially. A pressure sensor for measuring water pressure to detect the depth of water during a dive is mounted to this type of wristwatch. The pressure sensor must be mounted in such a manner that a pressure-sensitive part for detecting the pressure outside the wristwatch is at least exposed to the outside, or is in communication with the outside. A structure in which the pressure-sensitive part is directly exposed to the outside may result in a damage to the sensor or in a design defect. Therefore, as a conventional pressure sensor-mounting structure, a structure has been often adopted in which a pressure sensor is placed inside an insertion hole formed in a wall surface (a partition wall for partitioning the inside and outside of a wristwatch) of a watch case of the wristwatch, and a sensor cover is attached from the outside of the watch case to thereby communicate a pressure-sensitive part indirectly with the outside while covering the pressure-sensitive part.

FIG. 7 shows an example of a pressure sensor-mounting structure in a conventional diver's watch. An insertion hole 10*a* for communicating the inside with the outside of a watch case and having a circular cross section is formed in a partition wall 10 of the watch case, and a stepped portion 10*b* facing the outside is formed near the inner end of the insertion hole 10*a*. A pressure sensor 11 is inserted from the inside of the partition wall 10 into the insertion hole 10*a* and engages with the inner opening edge of the insertion hole 10*a*. The inner end of the pressure sensor 11 is pressed and supported from the inside to the outside by a sensor-pressing member 12 that is fixed to the partition wall 10 by a bolt 13 and a nut 14. A sensor protection plate 15 is set to the outer end of the pressure sensor 11, and a sensor cover 16 is attached and fixed from the outside of the sensor protection plate 15 to the partition wall 10 by a fixing screw 17.

In the sensor-mounting structure shown in FIG. 7, however, a pressure-sensitive part of the pressure sensor must be communicated with the outside, and water-resistance of the watch case must be ensured. Therefore, the number of components is increased, the component cost and assembly cost are increased, thereby increasing the cost of the product. Since a water-resistant structure of the bolt passing through the partition wall 10 to fix the pressure sensor is required in addition to a water-resistant structure of the pressure sensor, the number of water-resistant sections increases and reliability of the product with respect to the water-resistance deteriorates. Furthermore, since the water-resistance of the pressure sensor is secured by the sensor cover attached from the outside of the watch case, the water-resistance is easily degraded by removing the sensor cover from the outside, and the pressure sensor is easily damaged.

On the other hand, a structure for reducing the number of components and preventing the pressure sensor from being tampered from the outside is disclosed in Japanese Unexamined Utility Model Publication No. 6-69882. In the structure disclosed in the official gazette, a cylindrical mounting pipe is mounted and fixed to an insertion hole formed in a partition wall, a pressure sensor is inserted into the mounting pipe from the inside to be engaged therewith, and a sensor-fixing thread ring for pressing the inner end of the pressure sensor is threadedly engaged with a sensor pipe. According to this method, however, since the sensor pipe and the sensor-fixing thread ring are fixed by a screw structure, there is a risk that the thickness and area of the threadedly engaged portion may increase to hinder a reduction in size of a portable apparatus, such as a wristwatch. In addition, since the sensor-fixing screw ring must be rotated around a rotation axis that is substantially parallel to an opening of the watch case, assembly operation becomes difficult, and it is difficult to automate assembly.

The present invention solves the above problems, and an object is to provide a novel sensor-mounting structure which is applicable to various apparatuses, such as electronic apparatuses and portable apparatuses, and which can reduce the number of components, simplify the assembly operation, prevent tampering from the outside, and reduce the cost of manufacturing.

DISCLOSURE OF THE INVENTION

According to principles of the present invention a sensor-mounting structure comprises: an insertion part formed in a case partition wall constituting at least a part of a case body; a sensor engaged with the insertion part from the inside of the case partition wall; and a sensor-pressing member for pressing and supporting the inner end of the sensor from the inside of the case partition wall toward the insertion part; wherein an engaging part is provided on one side of the insertion part inside the case partition wall, and a fixing surface comprising a predetermined fixing structure is provided on the other side of the insertion part; and wherein one end of the sensor-pressing member is engaged and supported by the engaging part so as not to be disengaged from the insertion part, and the other end of the sensor-pressing member is superposed and fixed on the fixing surface.

According to the present invention, there is provided a structure in which the sensor engaged with the insertion part from the inside is pressed and supported by the sensor-pressing member from the inside. Therefore, the number of components is reduced, the sensor is difficult to access from the outside, and tampering and the like can be prevented. In addition, one end of the sensor-pressing member is engaged with the engaging part, and the other end is fixed to the fixing surface at the opposite side of the insertion part, whereby a component structure is simplified and the component cost can be reduced, and the assembly operation is simplified and assembly cost can be reduced.

According to one aspect of the present invention, it is preferable that the fixing surface have a surface along a plane crossing the inner wall face of the case partition wall, and the other end of the sensor-pressing member may have a shape conforming to the surface. Since the fixing surface has the surface along the plane crossing the inner wall face of the case partition wall, fixing operation of the sensor-pressing member can be easily performed. In this case, it is further preferable that the sensor-pressing member may be a plate-like member abutting against and pressing the inner end of the sensor. One end of the plate member may engage with the engaging part, and the other end of the plate member may be bent to form a fixing plate to be superposed on the fixing surface. The sensor-pressing member is the plate-like member and the above mounting structure is provided, whereby the mounting structure of the sensor-pressing member is simplified. In addition, a space occupied by the sensor-pressing member can be reduced, whereby the size of a portion of the sensor-mounting structure can be reduced, and a reduction in size of an apparatus or a device to which the sensor is mounted is not impeded. It is most preferable for the improvement of efficiency of assembly operation that the fixing surface intersects the inner wall face of the case partition wall at substantially 90 degrees.

Further, it is preferable that a sensor-accommodating frame for accommodating, engaging, and supporting the outer end of the sensor may be fixed to the insertion part, and a sealing member pressurized by the sensor-pressing member may be interposed between the sensor-accommodating frame and the sensor. By fixing the sensor-accommodating frame to the insertion part, the shape of a portion of the frame for receiving the sensor from the inside can be worked more easily, and sealing between the sensor-accommodating frame and the sensor can be sufficiently ensured by the sealing member.

The sensor-accommodating frame may be provided with a facing part capable of abutting against a part of the sensor-pressing member with the sealing ability between the sensor-accommodating frame and the sensor ensured. Since the facing part of the sensor-accommodating frame can be abutted against the sensor-pressing member while ensuring sealing ability between the sensor and the sensor-accommodating frame, posture stability of the sensor-pressing member can be ensured, assembly state for ensuring the sealing ability can be obtained more securely, and assembling operation can be performed more easily.

The fixing surface and the sensor pressing member may be fixed by a fixing screw which is inserted into the sensor-pressing member to be screwed into the fixing surface, or it is preferable that corresponding portions of the fixing surface and the sensor-pressing member may be provided with fitting parts which are mutually fitted based on the elasticity of a part of the sensor-pressing member, and the sensor-pressing member may be fixed to the fixing surface by the fitting parts. In the latter case, when the fixing surface is provided on the side of an opening of the case body, it is preferable that a fitting state of the sensor-pressing member and the fixing surface is not released by mounting a closing member for closing the opening of the case body.

The fixing surface may be provided on the side of an opening of the case body. By providing the fixing surface on the side of the opening of the case body, fixing operation of the sensor-pressing member and the fixing surface can be performed more easily. On the other hand, when one opening of the case body is provided, the engaging part engaging with one end of the sensor-pressing member is disposed at an inner part of the case body. However, since the one end is merely engaged with the engaging part, they do not interfere with the assembling operation. In this case, when the opening is closed by a closing member, such as a back cover or a transparent window, the fixing surface may preferably be formed inside an abutment end face to which the closing member is fixed in an abutted state. Furthermore, in order to secure a space for disposing the sensor-pressing member superposed on the fixing surface, it is preferable that the fixing surface may be formed at a position inside the abutment end face slightly extracted inside the opening from the abutment end face.

The sensor-mounting structure may be used in an electronic apparatus. In particular, the sensor-mounting structure used in a portable electronic apparatus can contribute a reduction in the cost of manufacturing or a reduction in size of the apparatus. Various types of sensors for detecting various physical quantities can be applied to the sensor in the above measures. In particular, a sensor may be preferable which can detect external circumstances by being in communication with the outside may be preferable.

Specifically the sensor-mounting structure may be used in a wristwatch which serves as a pressure sensor for detecting the pressure outside the case partition wall. An example of this type of wristwatch includes a wristwatch having the function of measuring air pressure or water pressure, such as a wristwatch having an altitude estimation function or a weather forecast function, or a wristwatch having a water depth estimation function based on the detected water pressure, or a diving information display function (a diver's watch, or a diver's computer).

In particular, the opening of the case body is closed by the back cover (in the case of a common watch) or the transparent window (in the case of a one-piece-type watch), and it is preferable that the fixing surface may be formed inside the abutment end face which is fixed to the back cover or the transparent window in an abutted state when the opening is closed by the back cover or the transparent window.

In this case, in order to secure a space for disposing the sensor-pressing member superposed on the fixing surface, it is preferable that the fixing surface may be formed at a position inside the abutment end face slightly extracted inside the opening from the abutment end face.

In place of the case partition wall of the case body in the above measures, various wall faces which are not limited to the case body may be constructed in a manner similar to the foregoing. In addition, a general use component which is mounted to the insertion part of the wall face in place of the sensor in the above measures, which includes a sensor and other various components, and which is not limited to the sensor, may be fixed in a manner similar to the foregoing.

BRIEF DESCRIPTION OF THE DRAWINGS

In the drawings, wherein like reference symbols refer to like parts.

DETAILED DESCRIPTION OF THE INVENTION

Embodiments according to the present invention will be described with reference to the drawings. The embodiments to be described hereinbelow basically show a sensor-mounting structure which is suitably constructed as a wristwatch for divers (a diver's watch) or a portable information-processing terminal (a diver's computer or a dive computer). However, the device according to the present invention is not limited to the wristwatch or the portable information-processing terminal, and the device can be used in various electronic apparatuses or portable apparatuses.

First Embodiment

Figure 1:
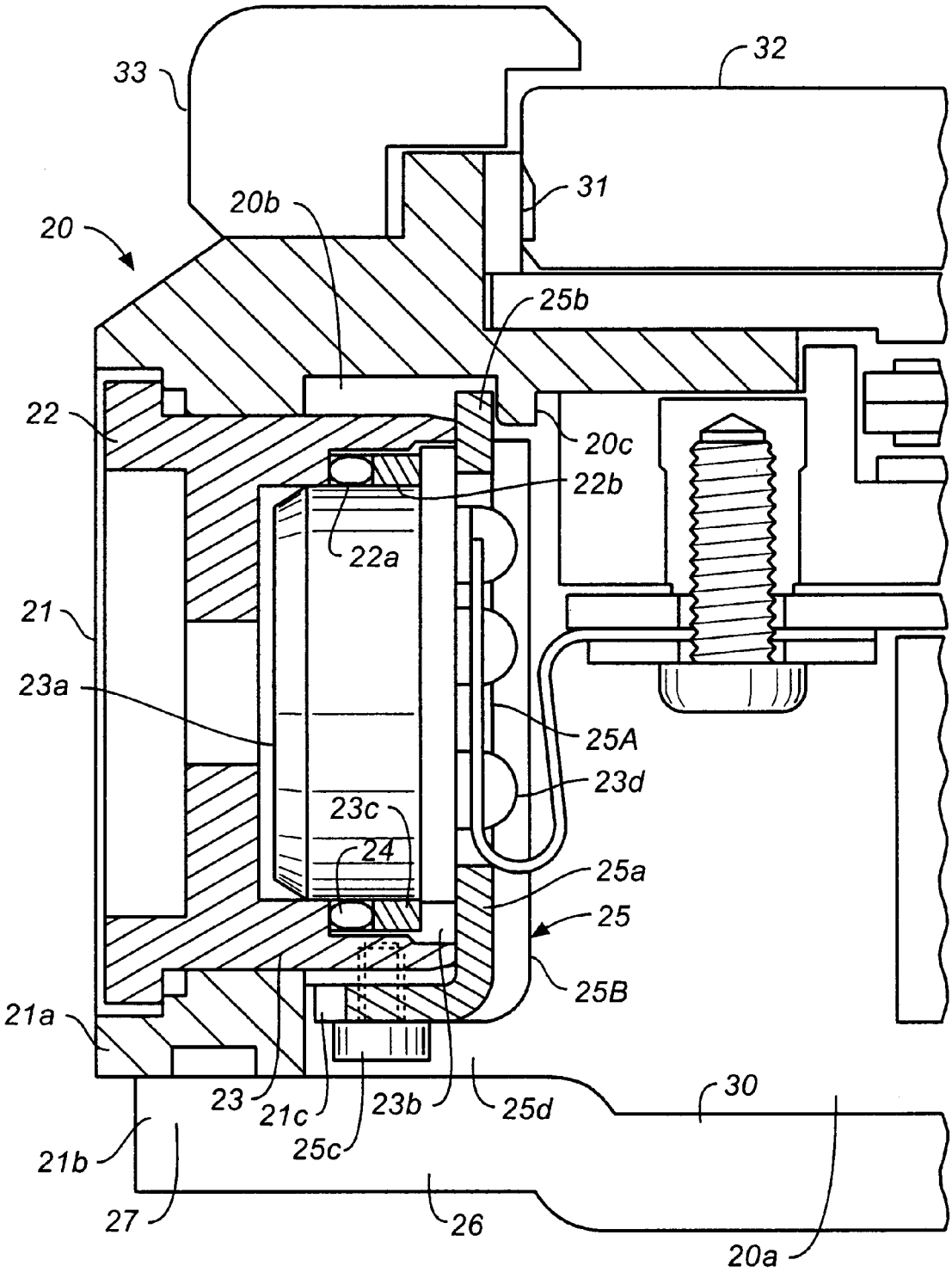
FIG. 1 is an enlarged vertical sectional view showing a structure in which a first embodiment of a sensor-mounting structure according to the present invention is applied to a wristwatch.
Figure 2:
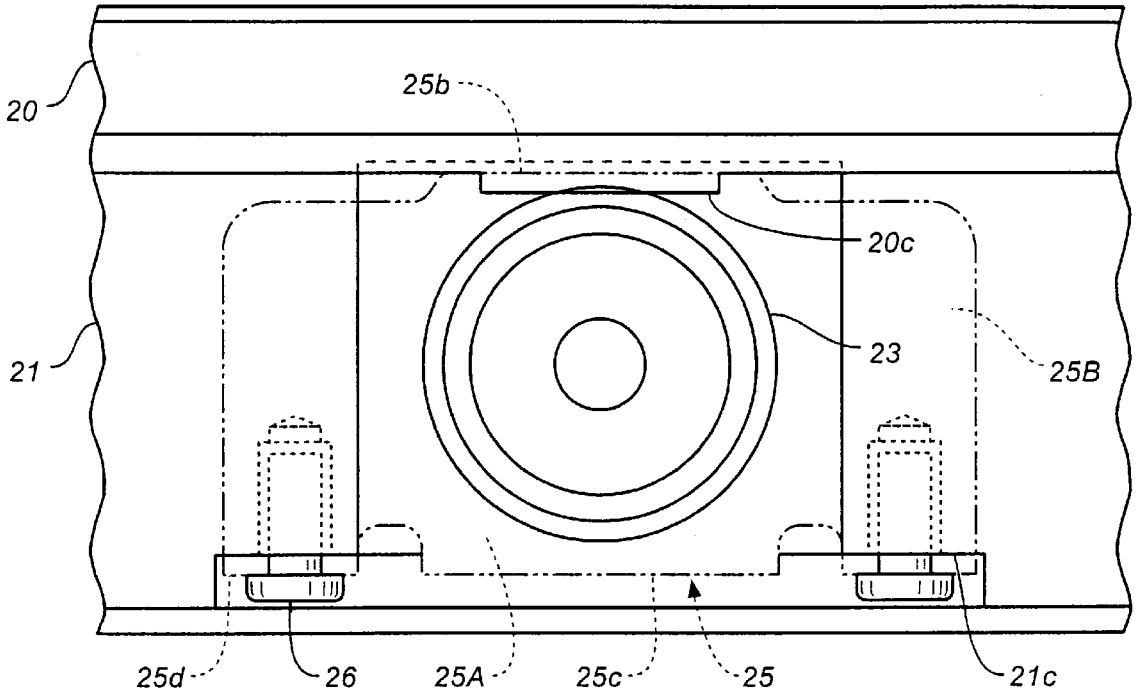
FIG. 2 is a side perspective diagram showing the structure of the first embodiment as viewed from the outside of a side face of a watch case.
Figure 3:
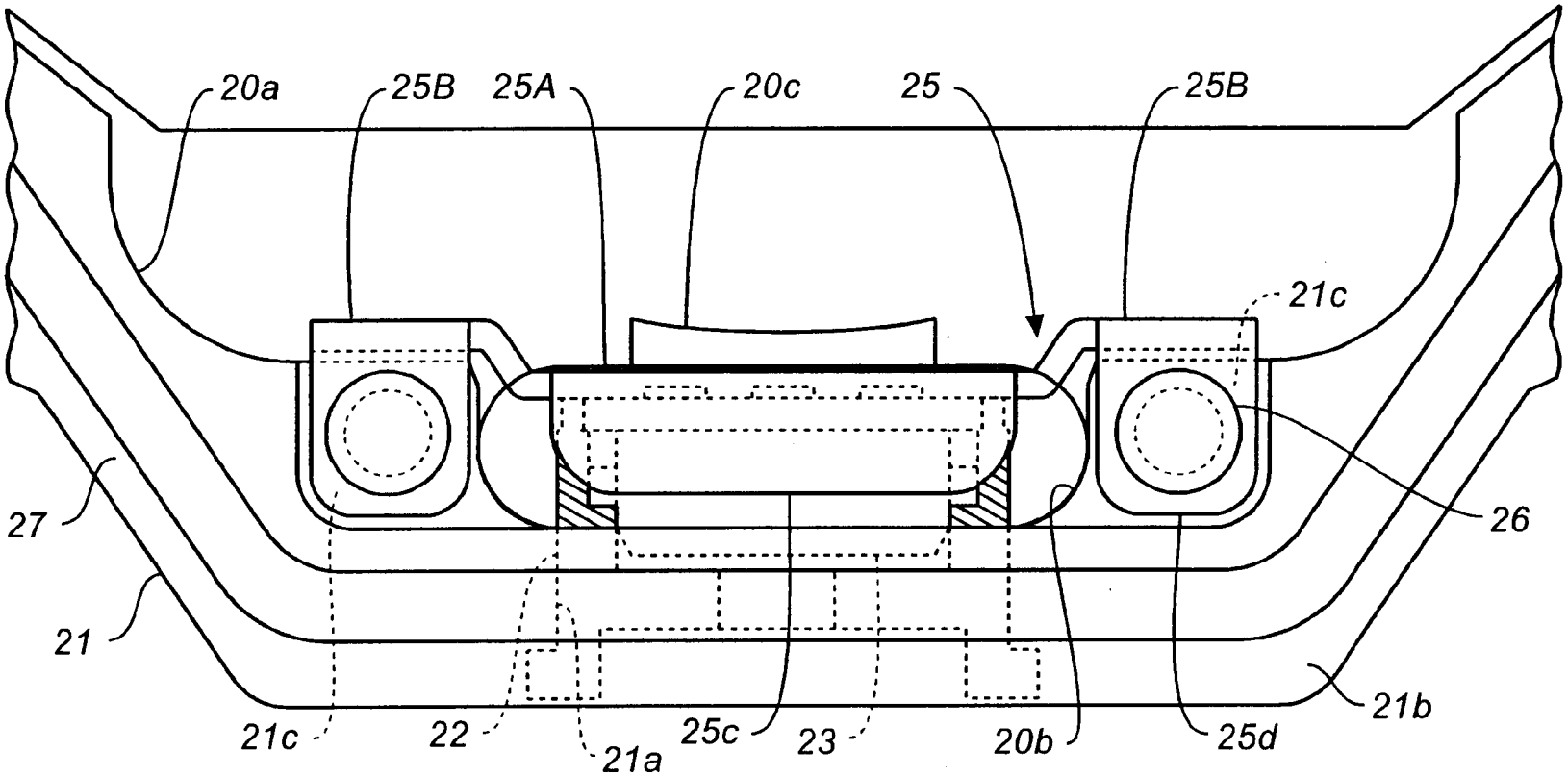
FIG. 3 is a bottom view showing the structure of the first embodiment as viewed from the back of the watch case.

FIGS. 1 to 3 show the first embodiment of a sensor-mounting structure according to the present invention. The embodiment relates to a structure incorporated into a wristwatch (diver's watch). As shown in FIG. 1, the structure includes a watch case 20, a back cover 30 for closing an opening 20*a* that is formed in the back of the watch case 20, a transparent glass 32 that is a transparent window member pressed and fixed to the front of the watch case 20 via a water resistant ring 31, and an ornamental frame 33 fixed to the outer periphery of the transparent glass 32.

The watch case 20 includes a partition wall 21 extending in the form of a frame in the direction of the thickness of the watch, and the partition wall 21 is formed with an insertion hole 21*a* having a circular cross section, which is a sensor-accommodating frame passing through the inside and outside of the watch case 20. A substantially cylindrical mounting pipe 22 is inserted into the insertion hole 21*a*, and is fixed by brazing. The mounting pipe 22 is constructed into a cylindrical shape so that it receives a pressure sensor 23 from the inside of the watch case 20 and engages with the pressure sensor 23 so that the pressure sensor 23 does not come out of the case 20. A stepped portion 22*a* is formed inside of a cylindrical part of the mounting pipe 22, and a packing 24 serving as a water resistant seal ring is accommodated in the stepped portion 22*a* in such a manner as to abut thereagainst. The pressure sensor 23 includes a pressure-sensitive part 23*a* at the outer end thereof, and a base plate 23*b* at the inner end thereof which is extended in the form of a flange. Furthermore, a presser ring 23*c* is attached to a stepped portion formed by the base plate 23*b*. The presser ring 23*c* may be integrated with the base plate 23*b* or a sensor main body. The packing 24 is disposed under pressure between the presser ring 23*c* and the stepped portion 22*a* of the mounting pipe 22 so as to serve as a water resistant seal between the mounting pipe 22 and the pressure sensor 23 provided inside thereof. A plurality of electrodes 23*d* is formed on the inner end of the pressure sensor 23, and the electrodes 23*d* are electrically connected to a circuit board placed inside the watch.

A pressing plate 25 serving as a sensor-pressing member is disposed inside the pressure sensor 23. The external shape of the pressing plate 25 as viewed in the axial direction of the pressure sensor 23 is shown in FIG. 2 by two-dot chain lines, and a bottom shape of the pressing plate 25 is shown in FIG. 3. The pressing plate 25 consists of a central pressing portion 25A formed in the center of a plane in FIG. 1, and a pair of side plates 25B formed on both front and back of the central pressing portion 25A. According to the bottom view shown in FIG. 3, it can be recognized that the central pressing portion 25A is in contact with the inner end of the pressure sensor 23, and the side plates 25B are formed on both left and right sides thereof so as to bend slightly toward the inside of the watch case 20. A central part of the central pressing portion 25A is formed with an opening 25*a* for avoiding the electrodes 23*d* formed on the inner end of the pressure sensor 23.

An engaging end 25*b* formed at the upper end of the central pressing portion 25A of the pressing plate 25 extends upward from the inner edge 22*b* of the mounting pipe 22, enters into a recess 20*b* formed in the inner surface of the watch case 20, and engages with an engaging rib 20*c* that is formed on an edge of the recess 20*b* and is projecting downward. The lower end of the central pressing portion 25A is bent substantially at right angles to form a bent portion 25*c* that enters below the mounting pipe 22. Tongue-like fixing plates 25*d* formed at the lower end of the side plates 25B are disposed on both front and back of the bent portion 25*c*. Each of the fixing plates 25*d* is bent at the lower end of each of the side plate 25B substantially at right angles, and then extends nearly horizontally in a tongue-like planar shape. Each of the fixing plates 25*d* is formed with a circular shaft hole.

An abutment end face 21*b* for abutting against the back cover 21 is formed at the lower end of the partition wall 21 of the watch case 20, and a pair of fixing surfaces 21*c* slightly drawn upward is formed inside the abutment end face 21*b*. A packing 27 incorporated into the abutment end face 21*b* shown in FIGS. 1 and 3 is for securing water resistance and airtightness between the partition wall 21 and the back cover 30. The fixing surfaces 21*c* are formed with circular threaded holes, and the fixing plates 25*d* are superposed on the fixing surfaces 21*c*. Fixing screws 26 pass through the shaft holes of the fixing plates 25*d* to be threadedly engaged with the threaded holes of the fixing surfaces 21*c*, whereby the pressing plate 25 is fixed to the watch case 20.

In this embodiment, the mounting pipe 22 is brazed into the insertion hole 21*a* formed in the partition wall 21 of the watch case 20, then the pressure sensor 23 is inserted into the mounting pipe 22 after the packing 24 has been inserted into the mounting pipe 22, and thereafter, the engaging end 25*b* of the pressing plate 25 is inserted into the recess 20*b* to be engaged with the engaging rib 20*c*. Finally, the fixing plates 25*d* of the pressing plate 25 are superposed on the fixing surfaces 21*c*, and the fixing screws 26 are screwed thereinto, whereby the pressure sensor 23 is completely fixed. In this case, the pressure sensor 23 must be pressed into the mounting pipe 22 by the central pressing portion 25A of the pressing plate 25, and the packing 24 must be pressurized so that the water resistance between the mounting pipe 22 and the pressure sensor 23 is certainly secured. The pressing plate 25 is constructed so as to abut against the inner edge 22*b* of the mounting pipe 22 with the water resistance secured as described above, whereby the mounting posture of the pressing plate 25 is stabilized, and the assembly operation can be easily performed. The water-resistant structure of the diver's watch must naturally have a high degree of pressure-resistance.

In this embodiment, since the pressure sensor 23 is merely inserted into the mounting pipe 23 to mount the pressing plate 25 thereto, the number of components is reduced, and the component cost can be reduced. In addition, in mounting the pressing plate 25, the fixing plates 25*d* may be fixed to the fixing surfaces 21*c* provided at the edge of the opening 20*a* of the watch case 20 after engaging the engaging end 25*b* with the engaging rib 20*c*. Therefore, the assembly operation is very easy, and assembly can be automated, so that assembly cost can be reduced. For example, the sensor-mounting structure can be easily assembled from the opening of the watch case without being disturbed by the inner structure of the watch case. Furthermore, in this embodiment, since the pressure sensor 23 is completely fixed from the inside to the mounting pipe 23 brazed to the watch case 20, it is impossible to remove the pressure sensor from the outside, and tampering and the like can be prevented. A sensor cover (not shown) may be attached to the partition wall 21 from the outside to protect the outer end of the mounting pipe 22 and to provide a design accent. However, the sensor cover is not relevant to the mounting structure of the pressure sensor 23. Furthermore, in this embodiment, since a large space is not required for mounting the pressure sensor 23, a reduction in size of the wristwatch is not impeded, and the mounting structure can be constructed in a compact manner.

Second Embodiment

Next, the second embodiment according to the present invention will be described with reference to FIGS. 4 and 5.

Figure 4:
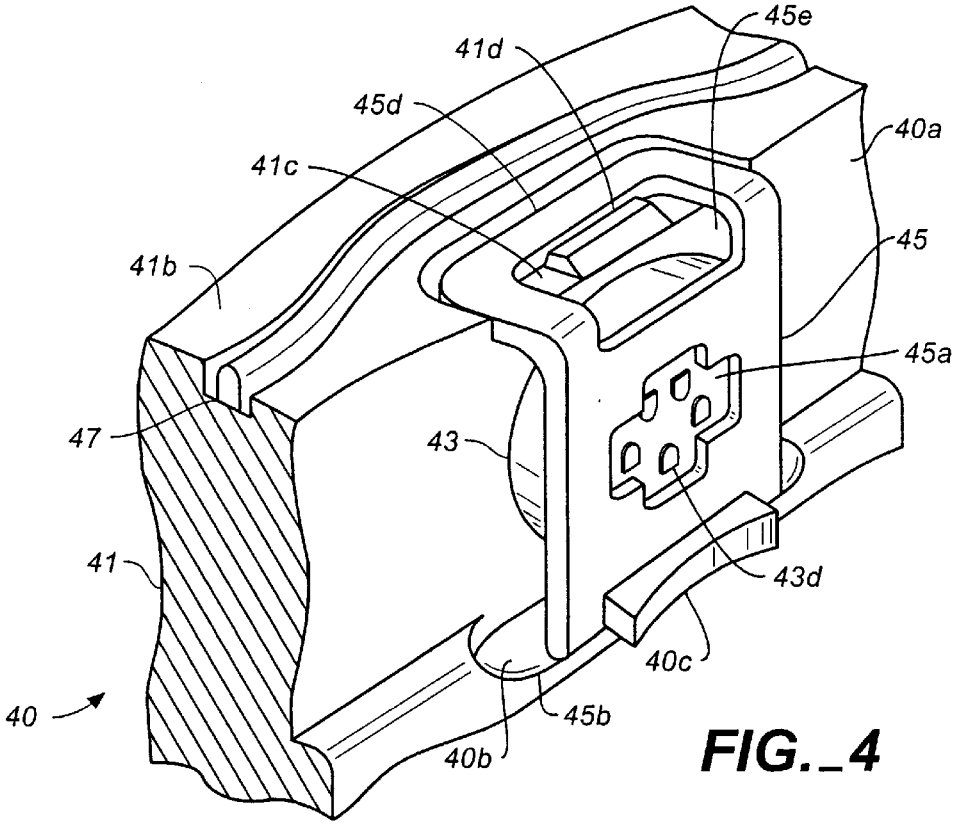
FIG. 4 is a partially perspective view as viewed from the diagonal back of the watch case in order to show a structure in which a second embodiment of the sensor-mounting structure according to the present invention is applied to a wristwatch.
Figure 5:
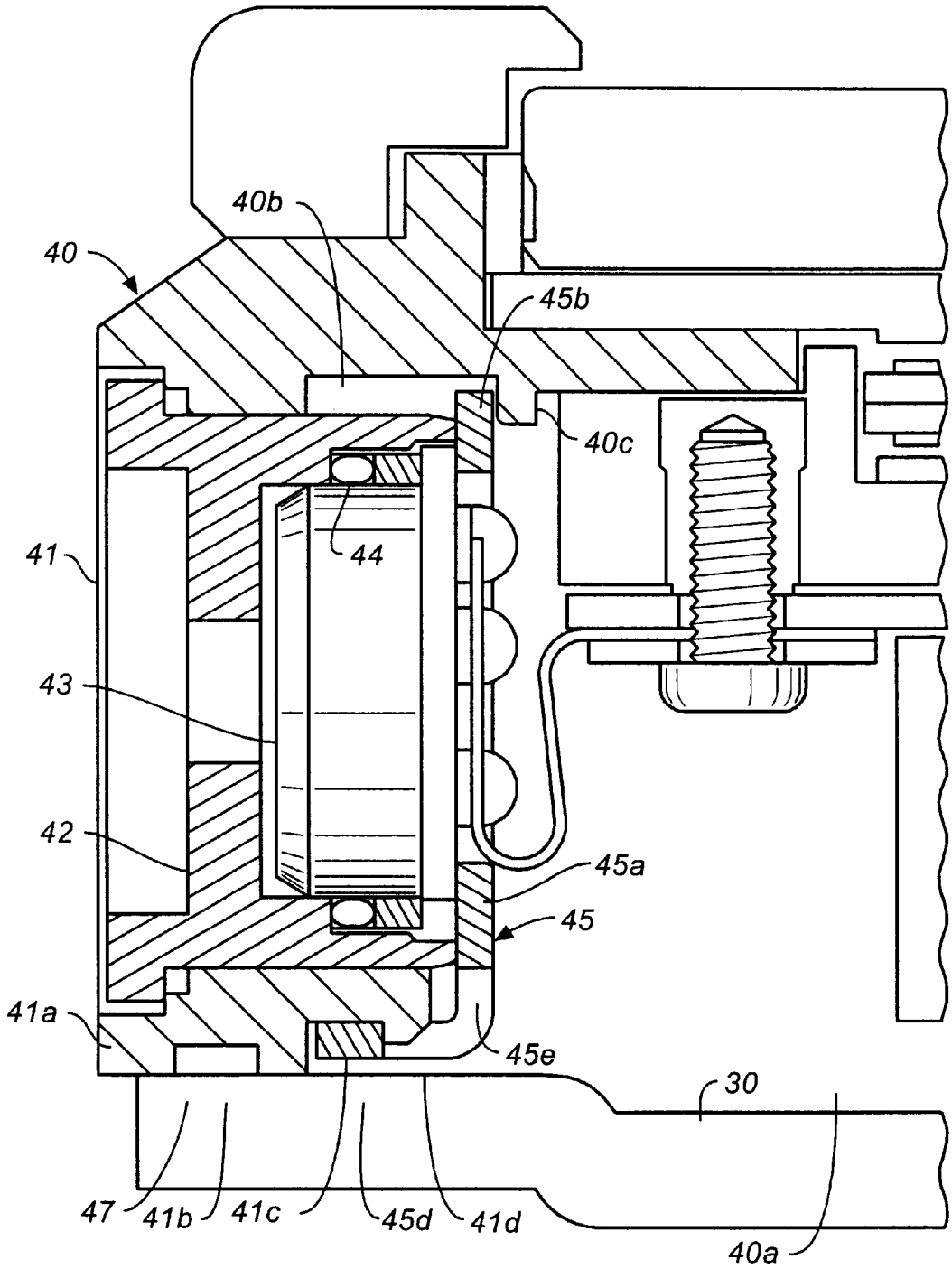
FIG. 5 is an enlarged vertical sectional view showing the structure of the second embodiment.
Figure 7:
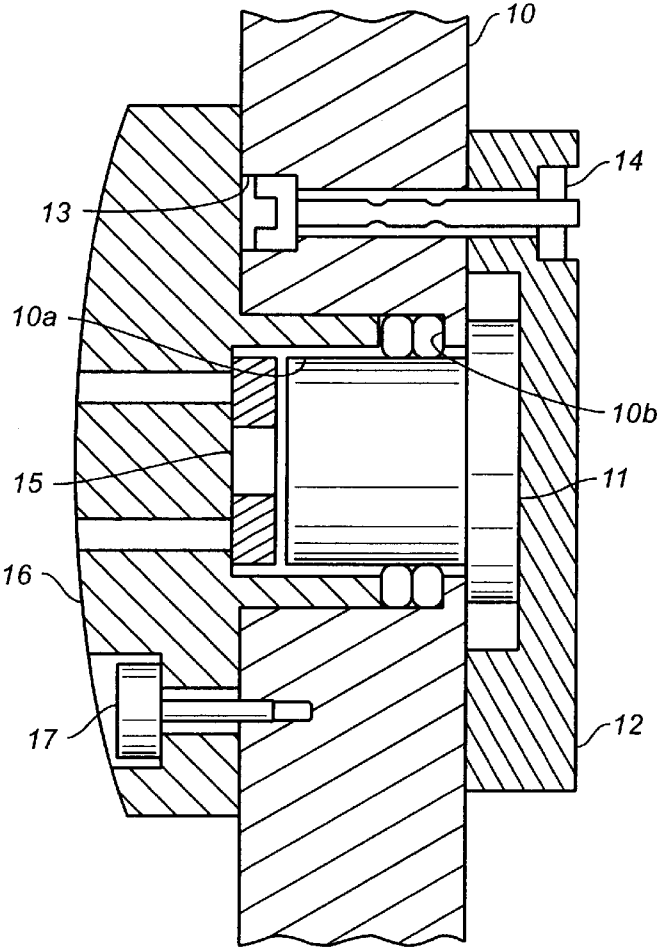
FIG. 7 is a sectional view showing an example of a pressure sensor-mounting structure in a conventional diver's watch.

In this embodiment, as shown in FIGS. 4 and 5, the basic structure is the same as that of the first embodiment in which a pressure sensor 43 is inserted from the inside into an insertion part of a partition wall 41 of a watch case 40, and an inner end of the pressure sensor 43 is pressed and fixed by a pressing plate 45. However, the shape of the pressing plate 45, and the mounting structure between the pressing plate 45 and the watch case 40 are different from those of the first embodiment.

In this embodiment, an engaging end 45*b* of the pressing plate 45 is inserted into a recess 40*b* of the watch case 40 to engage with an engaging rib 40*c*. On the other hand, an end of a fixing plate 45*d* on the opposite side of the engaging end 45*b* is bent substantially at right angles to extend substantially in parallel with an abutment end face 41*c* of the partition wall 41. The pressing plate 45 is formed with an opening 45*a* for avoiding electrodes 43*d* of the pressure sensor 43, and an engaging opening 45*e* from a part of the pressing plate 45 pressing the pressure sensor 23 to the fixing plate 45*d*.

A packing 47 is incorporated into the abutment end face 41*b* of the partition wall 41 in a manner similar to the first embodiment. A fixing surface 41*c* that is constructed so as to be retracted one step from the abutment end face 41*b* toward the pressure sensor 43 is provided on an inner portion of the abutment end face 41*b* from the packing 47. An engaging projection 41*d* partially projecting from the fixing surface 41*c* is formed on the inner part of the fixing surface 41*c*. The fixing plate 45*d* of the pressing plate 45 passes over the engaging projection 41*d* to be fitted and fixed in such a manner as to overlap the fixing surface 41*c*. In this state, the engaging projection 41*d* is accommodated in the engaging opening 45*e*.

In this embodiment, as shown in FIG. 5, a mounting pipe 42 is mounted and fixed by brazing and the like into the insertion hole 41*a* formed in the partition wall 41, a packing 44 is inserted into the mounting pipe 42 from the inside, and then the pressure sensor 43 is inserted and the pressing plate 45 is attached thereto. Mounting operation of the pressing plate 45 is performed by pressing the fixing plate 45*d* into the fixing surface 41*c* after engaging the engaging end 45*b* with the engaging rib 40*c*, and by fitting the engaging projection 41*c* into the engaging opening 45*e* in such a manner as to be introduced using the elasticity of the pressing plate 45. In this embodiment, when a back cover 30 is attached after mounting the pressing plate 45, the inner surface of the back cover 30 opposes the fixing surface 41*c* with a slight gap. Therefore, the fixing plate 45*d* disposed at a position sandwiched by the back cover 30 and the fixing surface 41*c* is prevented from being disengaged from the engaging projection 41*d*.

In this embodiment, since a screw structure is eliminated, the cost of manufacturing the components can be reduced. In addition, since the mounting operation of the pressing plate 45 can be performed with nearly a single motion due to the above fitting structure, the mounting operation can be performed even more easily than in the first embodiment, the structure can be assembled quickly without the need for using a tool, and the assembly cost can be reduced.

Third Embodiment

Figure 6:
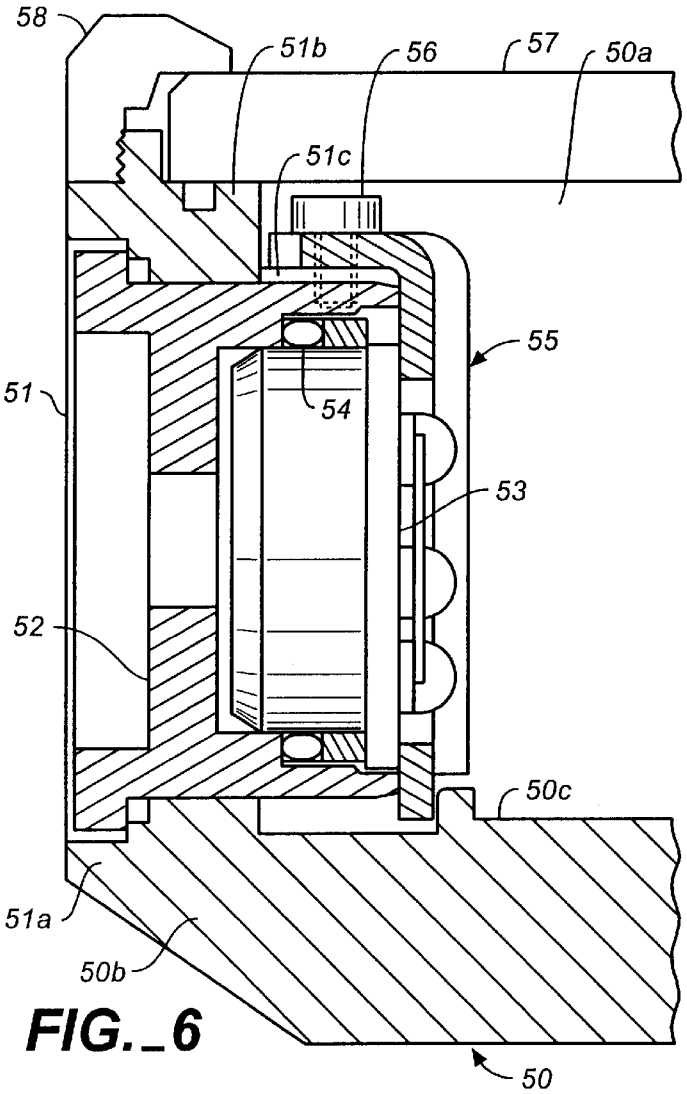
FIG. 6 is an enlarged vertical sectional view showing a structure in which a third embodiment of the sensor-mounting structure according to the present invention is applied to a wristwatch including a one-piece-type watch case.

Finally, the third embodiment according to the present invention will be described with reference to FIG. 6. This embodiment is applied to a wristwatch (a diver's watch) using a one-piece-type watch case 50 in which a back cover is integrated with a common watch case. An opening 50*a* is formed in the upper side (display side) of a watch case 50. In the wristwatch, a movement, a dial and the like are inserted from the opening 50*a*, and then a transparent glass 57 is attached thereto so as to close the opening 50*a*, the outer periphery of the transparent glass 57 is brought into abutment against an abutment end face 51*b* of a partition wall 51 via a packing, and finally, the transparent glass 57 is fixed by a glass-fitting ring 58.

The partition wall 51 of the watch case 50 is formed with an insertion hole 51*a*, and a mounting pipe 52 is fixed into the insertion hole 50*a* by brazing and the like. A pressure sensor 53 is inserted into the mounting pipe 52 via a packing 54, and finally, a pressing plate 55 is attached thereto, whereby the pressure sensor 53 is pressed and fixed to the mounting pipe 52.

In this embodiment, the pressing plate 55 has substantially the same shape as the pressing plate 25 of the first embodiment. However, this embodiment differs from the first embodiment in that a recess 50*b* and an engaging rib 50*c* is formed on the inner surface of the lower part of the watch case 50, and a fixing surface 51*c* is formed inside the partition wall 51 which corresponds to an opening edge of the opening 50*a* formed in the upper part of the watch case 50. That is, the formation position of the opening 50*a* of the watch case 50 is inverted with respect to the case of the first embodiment, and the formation positions of the engaging rib 50*c* and the fixing surface 51*c* are correspondingly inverted, and consequently, the mounting posture of the pressing plate 55 is inverted.

In this embodiment, in a manner similar to the first embodiment, the number of components is reduced, a reduction in size of the wristwatch is not impeded, the assembly operation is easy, and the cost of manufacturing can be reduced.

As described above, according to the present invention, there is provided a structure in which a sensor engaged with an insertion part from the inside is pressed and supported by a sensor-pressing member from the inside. Therefore, the number of components is reduced, the sensor is difficult to access from the outside, and tampering and the like can be prevented.

In addition, one end of the sensor-pressing member is engaged with an engaging part, and the other end is fixed to a fixing surface at the opposite side of the insertion part, whereby a component structure is simplified and the component cost can be reduced, and the assembling operation is simplified and assembly cost can be reduced.

What is claimed is:

1. A sensor-mounting structure comprising:

an insertion part formed in a case partition wall constituting at least a part of a case body;

a sensor engaged with the insertion part from the inside of the case partition wall;

and a sensor-pressing member for pressing and supporting the inner end of the sensor from the inside of the case partition wall toward the insertion part;

wherein an engaging part is provided on one side of the insertion part inside the case partition wall, and a fixing surface comprising a predetermined fixing structure is provided on the other side of the insertion part; and wherein one end of the sensor-pressing member is engaged and supported by the engaging part so as not to be disengaged from the insertion part, and the other end of the sensor-pressing member is superposed and fixed on the fixing surface.

2. A sensor-mounting structure according to claim 1, wherein the fixing surface has a surface along a plane crossing the inner wall face of the case partition wall, and the other end of the sensor-pressing member has a shape conforming to the surface.

3. A sensor-mounting structure according to in claim 1, wherein a sensor-accommodating frame for accommodating, engaging, and supporting the outer end of the sensor is fixed to the insertion part, and a sealing member pressurized by the sensor-pressing member is interposed between the sensor-accommodating frame and the sensor.

4. A sensor-mounting structure according to claim 3, wherein the sensor-accommodating frame is provided with a facing part capable of abutting against a part of the sensor-pressing member with the sealing ability between the sensor-accommodating frame and the sensor ensured.

5. A sensor-mounting structure according to claim 1, wherein the fixing surface and the sensor pressing member are fixed by a fixing screw which is inserted into the sensor-pressing member to be screwed into the fixing surface.

6. A sensor-mounting structure according to claim 1, wherein corresponding portions of the fixing surface and the sensor-pressing member are provided with fitting parts which are mutually fitted based on the elasticity of a part of the sensor-pressing member, and the sensor-pressing member is fixed to the fixing surface by the fitting parts.

7. A sensor-mounting structure according to claim 1, wherein the fixing surface is provided on the side of an opening of the case body.

8. An electronic apparatus comprising a sensor-mounting structure as claimed in claim 1.

9. A wristwatch comprising a sensor-mounting structure as claimed in claim 1, wherein the sensor is a pressure sensor for detecting the pressure outside the case partition wall.

* * * * *

UNITED STATES PATENT AND TRADEMARK OFFICE

CERTIFICATE OF CORRECTION

PATENT NO. : 6,278,659 B1
DATED : August 21, 2001
INVENTOR(S) : Kiyomitsu Yokouchi It is certified that error appears in the above-identified patent and that said Letters Patent is hereby corrected as shown below:

Title page,
Item [54], Title, change "SENSOR MOUNTING STRUCTURE AND ELECTRONIC AND WATCH HAVING THE STRUCTURE" to -- SENSOR MOUNTING STRUCTURE, AND ELECTRONIC APPARATUS AND WRISTWATCH INCLUDING THE SAME --.
Item [86], change "PCT No.: PCT/JP99/08286" to -- PCT/JP99/03286 --.

Signed and Sealed this

Twenty-sixth Day of March, 2002

*Attest:*

*Attesting Officer*

JAMES E. ROGAN
*Director of the United States Patent and Trademark Office*